US007341118B2

(12) United States Patent
Viel et al.

(10) Patent No.: US 7,341,118 B2
(45) Date of Patent: Mar. 11, 2008

(54) ROTATING DRY DRILLING BIT

(75) Inventors: Marcel Viel, Sudbury (CA); Dale Boucher, Sudbury (CA)

(73) Assignee: Northern Centre for Advanced Technology Inc., Sudbury (CA)

( * ) Notice: Subject to any disclaimer, the term of this patent is extended or adjusted under 35 U.S.C. 154(b) by 351 days.

(21) Appl. No.: 11/156,018

(22) Filed: Jun. 20, 2005

(65) Prior Publication Data

US 2006/0283637 A1 Dec. 21, 2006

(51) Int. Cl.
*E21B 25/14* (2006.01)

(52) U.S. Cl. ..... 175/245; 175/403

(58) Field of Classification Search ..... 175/332, 175/245, 403
See application file for complete search history.

(56) References Cited

U.S. PATENT DOCUMENTS 2,306,491 A * 12/1942 Noble et al. ..... 175/332
2,621,026 A * 12/1952 Stokes ..... 175/332
4,098,362 A * 7/1978 Bonnice ..... 175/430
4,440,247 A * 4/1984 Sartor ..... 175/393
5,379,852 A * 1/1995 Strange, Jr. ..... 175/403

* cited by examiner

*Primary Examiner*—Frank Tsay
(74) *Attorney, Agent, or Firm*—J. Gordon Thomson

(57) ABSTRACT

A rotating dry drilling bit for low thrust drilling of an annular bore hole into a body of rock and obtaining an extremely small diameter core sample comprises a bit crown moulded to the end of an annular steel body. The bit crown comprises a plurality of radially extending channels and a plurality of evenly spaced radially extending cutting blades surrounding an annulus. The bit crown is a hard metal matrix formed onto the bottom end of the annular steel body using a powdered metallurgy process. Embedded within each cutting blade are natural and synthetic diamonds. A reverse auger mechanism within the annulus removes cuttings from the annulus and the surface of the bit crown.

40 Claims, 15 Drawing Sheets

ROTATING DRY DRILLING BIT

BACKGROUND OF THE INVENTION

The present invention relates generally to the field of drill bits for core boring and more particularly to a rotating dry drilling bit for low thrust boring operations in very remote locations.

Core boring or "diamond drilling" is well known in the fields of geophysics, mineral and hydrocarbon exploration. Generally a drill bit is attached to the end of a rotating string. The drill bit comprises a bit crown with cutting blades including abrasive elements, such as natural and/or synthetic diamonds, impregnated therein. The know art discloses a variety of core drill bits for high thrust drilling operations such as is necessary to penetrate thick rock layers. The friction generated by high thrust drilling also necessitates the use of drilling mud to lubricate and cool the drill bit. U.S. Pat. No. 4,760,888 "Drill Bit for Core Boring" issued to Saito on Aug. 2, 1988 and U.S. Pat. 6,474,425 "Asymmetric Diamond Impregnated Drill Bit" issued to Truax et al on Nov. 5, 2002 are exemplary. These drill bits are robust and well suited to high thrust drilling and coring operations that are land based or extend from a deep see drilling rig and obtain core samples that are meters long and centimeters in diameter.

However, with the advent of extreme depth submarine and remote extra-terrestrial exploration, high thrust drilling is not practical because of the weight restrictions that such exploration entails and the impracticality of using a lubricating and cooling fluid. Drilling equipment for submarine and extra-terrestrial must be small and light for transportation and therefore low powered. Such low powered drilling equipment is unable to utilize the large scale heavy drill bits used in terrestrial drilling applications.

Therefore there is a need for a coring drill bit that is able to be used dry in low thrust drilling in extremely remote locations.

SUMMARY OF THE INVENTION

A principal object of the present invention is the provision of coring bit that is able to be used in extremely remote locations with low thrust drilling equipment.

Another object of the present invention is the provision of a coring bit that can be used dry.

Still another object of the present invention is the provision of a coring bit that is able to provide a core sample that is small and light and can be transported for analysis.

The above and other objects of the present invention will become apparent from a reading of the following description taken in conjunction with the accompanying drawings which illustrate the preferred embodiments thereof.

The objects of the present invention are satisfied by providing a rotating dry drilling bit for drilling an annular bore hole into a body of rock and obtaining a core sample from the body of rock. The drill bit comprises an annular steel body having a first annulus, an inside diameter, a bottom end and a top end. The top end is adapted for coupling with a rotating drill string. The drill string has a second annulus with a second inside diameter. A bit crown is mounted to the annular steel body bottom end. The bit crown has a top end and a bottom end and includes a third annulus having an inside diameter, a bottom rim and a top rim. The third annulus extends through the bit crown and is adapted to receive and pass the core sample to the second annulus of the drill string. The bit crown includes a bit head having a radial profile for cutting into the body of rock thereby forming the core sample and creating cuttings. The bit head also includes a radial outer face having a vertical profile and adapted for stabilizing the bit head against angular deviation and gauging the annular bore hole. Within the radial outer face is included a plurality of vertically oriented and parallel splines for stabilizing the bit head in the bore hole. The bit crown further includes a plurality of radially extending channels and cutting blades formed therein and evenly spaced thereabout. The cutting blades are equipped with abrasive elements that comprise natural diamonds such as 50SPC AAAA grade natural diamonds combined with synthetic diamond crystals impregnated into the volume of the bit crown. In another embodiment of the invention the abrasive elements comprise synthetic diamonds in the form of thermally stable polycrystalline diamond elements plus synthetic diamond crystals impregnated into the volume of the bit crown. A row of abrasive elements combining natural diamonds 75 SPC AAAA grade natural diamonds and 75SPC Kicker grade natural diamonds or, alternatively, synthetic diamonds is also inserted into each of the surfaces of each of the splines.

A transition zone adapted for receiving the cuttings from the plurality of channels is also provided. The steel body is machined from C12L14 steel. The bit crown is a hard metal matrix formed onto the bottom end of the steel body using a powdered metallurgy process. A reverse augering mechanism is included within the drill bit aperture to remove cuttings from the drill bit.

Other embodiments of the invention are disclosed herein having bit crowns having differing geometries.

DETAILED DESCRIPTION

A First Embodiment

Figure 1:
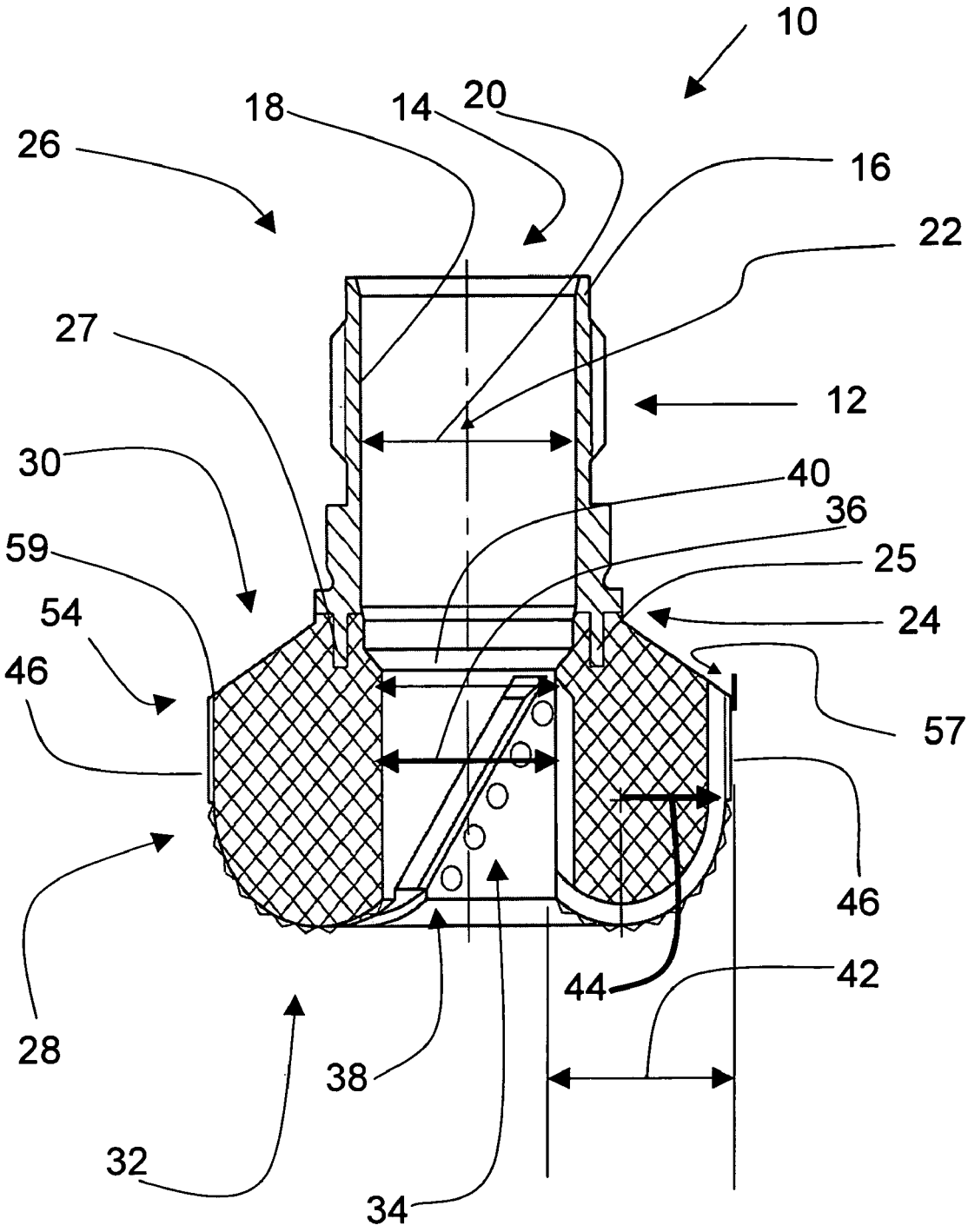
FIG. 1 is a cross-sectional side view of a first embodiment of the invention.

Referring now to FIG. 1, there is shown in a cross-sectional side view a first embodiment of our invention identified generally as (10). Our invention comprises a rotating dry drilling bit for drilling an annular bore hole into a body of rock and obtaining a core sample from the body of rock. What is unique about our drill bit is that it is used dry, that is, without any drilling fluids or mud to lubricate the drilling process and carry the cuttings away from the drill head. What is also unique about our dry drill bit is that it is used to obtain cylindrical core samples having diameters which are very small, that is, for example, between 5 mm and 15 mm.

Dimensions provided throughout this detailed description related to a particular embodiment of the invention. A person skilled in the art would readily understand that these dimensions can vary depending on the operational requirements of the drilling project.

The rotating dry drilling bit of our invention is about 31.4 mm long and comprises an annular steel body (12) having a first annulus (14), a cylindrical wall (16) having an inner surface (18), a first inside diameter (20) of about 12.4 mm, an axis (22), a bottom end (24) and a top end (26). The top end (26) of the annular steel body (12) is adapted for coupling with a co-axial rotatable drill string not shown in this diagram. The drill string has a second annulus with a second inside diameter equal to inside diameter (20).

There is a co-axial bit crown shown generally as (28) which is about 30 mm in diameter and mounted to the annular steel body bottom end (24) over integral anchors (25) and (27). The bit crown can have different geometries as shown in other embodiments of our invention.

In this embodiment, the bit crown has a top end (30) and a bottom end (32) and comprises a third annulus (34) having a third inside diameter (36) of about 10.13 mm, a bottom rim (38) and a top rim (40). The third annulus (34) extends through the bit crown and is co-axial with the first (14) and second annuli. The third annulus (34) is further adapted to receive and pass the core sample to the annular steel body first annulus (14) and hence to the drill string second annulus. The radius (44) of the bit crown is about 6 mm and determines the amount of point loading on the bottom end (32) of the bit crown. The radius of bit crown in this embodiment ensures that a high loading is achieved to commence the core as well as encouraging cuttings to exit through the channels (50) (FIG. 2) away from the bit crown as more filly explained below. There is a bit head (42) also called a "kerf" which is the surface area of the drill which experiences the greatest thrust during drilling operations. By design, the width of the kerf should be as narrow as possible in order to maximize the point loading on the cutting surfaces of the drill bit. In our design, the geometry of the kerf is optimized to obtain a maximum point load upon the bit during low thrust drilling. Such low thrust drilling might be necessary on an extraterrestrial surface such as the moon or Mars. Another factor which must be taken into consideration when designing the geometry of the kerf is the frequency with which the drill bit must be replaced. Understandably, in remote locations, it may be impossible to change the drill head. Hence, a geometry which ensures long life of the bit head is desirable for such applications. One factor which influences the size of the kerf is the size of the core sample desired. The kerf of our invention is guided by the equation with reference to FIG. 1:

$$K=0.5(S)+X+2T-(0.5(C)),\ \text{wherein}$$

K=minimum kerf (Item 42)
C=core sample outside diameter (Item 36)
S=core sample capture mechanism outer diameter (Item 40)
X=loose fit clearance room (nominal 0.5 mm to 1 mm)
T=depth of thread connecting the drill bit to the drill string.
A=crown auger depth (Item 51 FIG. 2)

The bit crown includes a plurality of radial outer faces (46). The radial outer faces (46) have a vertical profile and are about 5 mm high. They are adapted for stabilizing the bit head (28) against angular deviation as well as gauging the annular bore hole.

Figure 3:
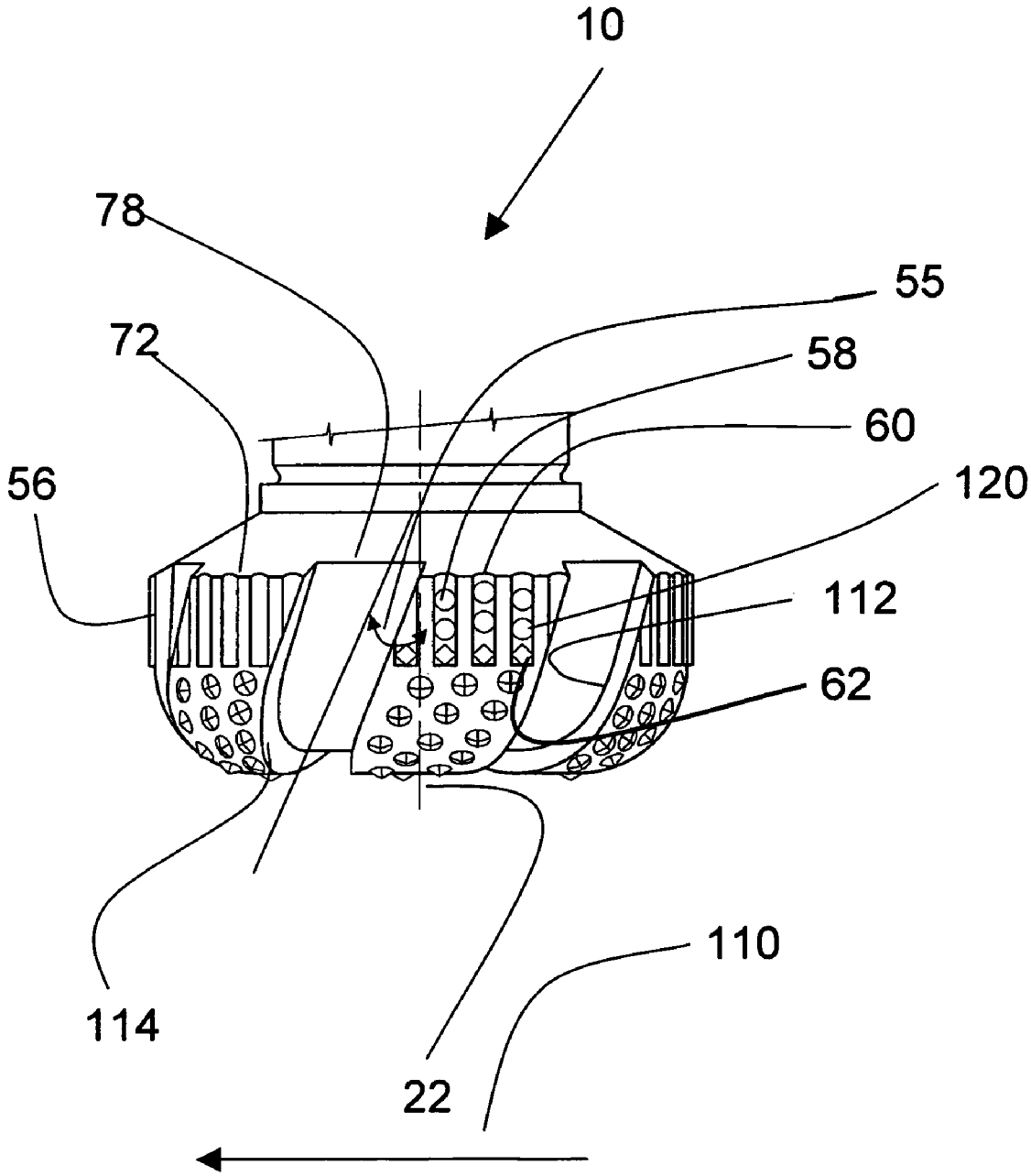
FIG. 3 is an elevation view of a first embodiment of the invention.

Referring now to FIG. 3, there is shown, in side view, the drill bit (10). Within each of the radial outer faces (46) there is embedded a plurality of vertically oriented and parallel splines (56). Each of the splines has a surface (58), a top end (60) and a bottom end (62).

Referring back to FIG. 2, there is illustrated a bottom view of the bit crown (28) showing the top rim (38) of third annulus (34). Formed within the within the bit crown (28) is a plurality of evenly spaced radially extending channels (50) adapted for carrying cuttings away from the bit head (28) by centrifugal force as the drill bit rotates. It is necessary to be able to clean the kerf of cuttings as the drill operates to avoid glassing and over grinding the cuttings which greatly reduces the efficiency of the drill. However, under low thrust conditions, some cuttings present under the kerf will act to lubricate the drill bit. In operation, the channels rotate with the drill and act as an auger to remove cuttings away from the bit head by centrifugal forces. The depth (51) and profile of the channels are dependent upon the speed of the drill (RPMs) and the volume of cuttings anticipated. A higher drill speed will tend to increase the efficiency of the channels in removing cuttings away from the bit head.

As well, the bit crown (28) has a plurality of evenly spaced radially extending cutting blades (52). Each one of the radially extending cutting blades (52) is separated by one of the radially extending channels (50). In the embodiment illustrated in FIGS. 1 and 2, there are six cutting blades and six channels although there may be more or less of each.

Figure 2:
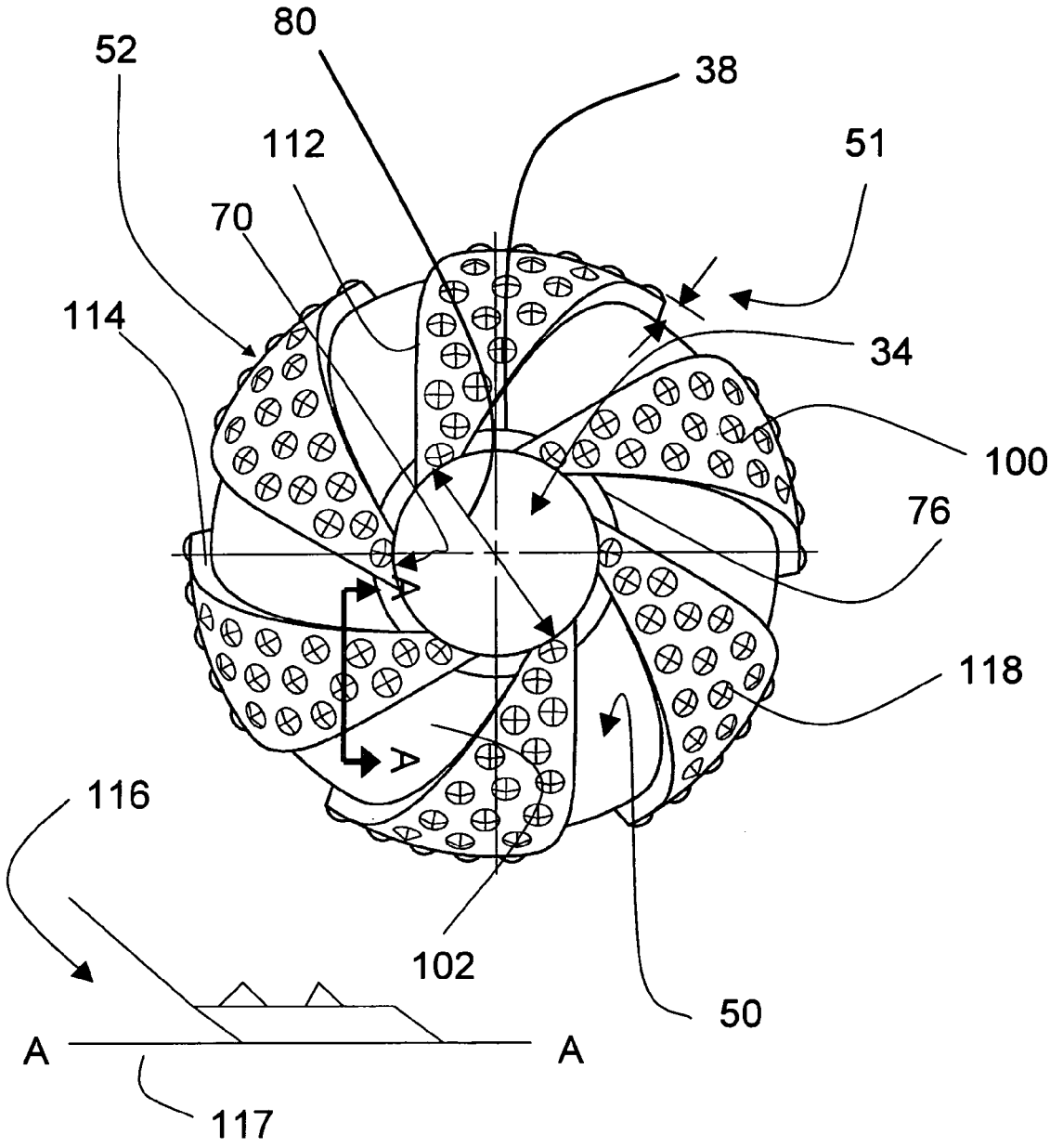
FIG. 2 is a bottom view of the first embodiment of the invention.

Referring to FIG. 2 and FIG. 3, each radially extending cutting blade (52) has a blade surface area generally indicated at (100). Each blade has an increasing tapered width from the bottom end (70) of the blade to the top end (72) of the blade. As well, each radially extending channel (50) has a channel surface area generally shown as (102) and an increasing tapered width from the bottom end (76) or inlet of the channel of about 2.5 mm to the top end (78) or outlet of the channel of about 6.3 mm. The surface area (100) of each blade (52) is greater than the surface area (102) of each channel (50) in this embodiment. However, this is not the case in all embodiments and is dependent upon the requirements of the drilling project.

As shown in FIG. 3, each radially extending cutting blade (50) and each radially extending channel (52) has a diagonal orientation at an angle (55) conforming to the direction of rotation (110) of the rotating dry drill bit. The diagonal orientation is generally about 24 degrees from the vertical axis (22) but the angle may be fore or less than 24 degrees. As noted above, this angled configuration promotes the auguring action of the drill bit to remove cuttings from the drill bit.

Referring still to FIGS. 2 and 3, the blade surface (100) is raised above the channel surface (102) a predetermined distance (51) (about 1 mm in this embodiment) thereby creating blade surface opposite side walls comprising a blade surface leading side wall (112) and a blade surface lagging side wall (114). As shown in FIG. 2, Section A-A, the blade surface leading side wall (112) and the blade surface lagging side wall (114) are angled at a predetermined angle (116) towards the direction of rotation of the dry drilling bit. The angle (116) is about 24 degrees from the horizontal (117) as shown in Section A-A but it may be more or less than 24 degrees. A plurality of abrasive elements (118) is embedded into the blade surface providing a relief of about 0.3 mm above the surface of the blade. In one embodiment of the invention the abrasive elements comprise natural diamonds such as 50SPC AAAA grade natural diamonds and synthetic diamond crystals impregnated into the volume of the bit crown. In another embodiment of the invention the abrasive elements comprises synthetic diamonds in the form of thermally stable polycrystalline diamond elements plus synthetic diamond crystals impregnated into the volume of the bit crown. A row of abrasive elements (120), combining natural diamonds 75 SPC AAAA grade natural diamonds and 75SPC Kicker grade natural diamonds or, alternatively, synthetic diamonds is also inserted into each of the surfaces of each of the splines (56).

Referring back to FIG. 1, there is a transition zone (54) that is adapted for receiving the cuttings from the plurality of channels (50) and then transporting them to auguring means located above the drill bit on the drill string. The transitional zone (54) comprises an upwardly inclined surface (59) extending at a predetermined angle (57) of about 60 degrees from the top of the radial outer face (46) to the surface of the annular steel body (12). The angle may be more or less than 60 degrees.

The annular steel body is machined from a species of steel commonly referred to as "C12L14 Grade" steel.

The bit crown is a hard metal matrix formed onto the bottom end of the annular steel body using a powdered metallurgy process.

Figure 4:
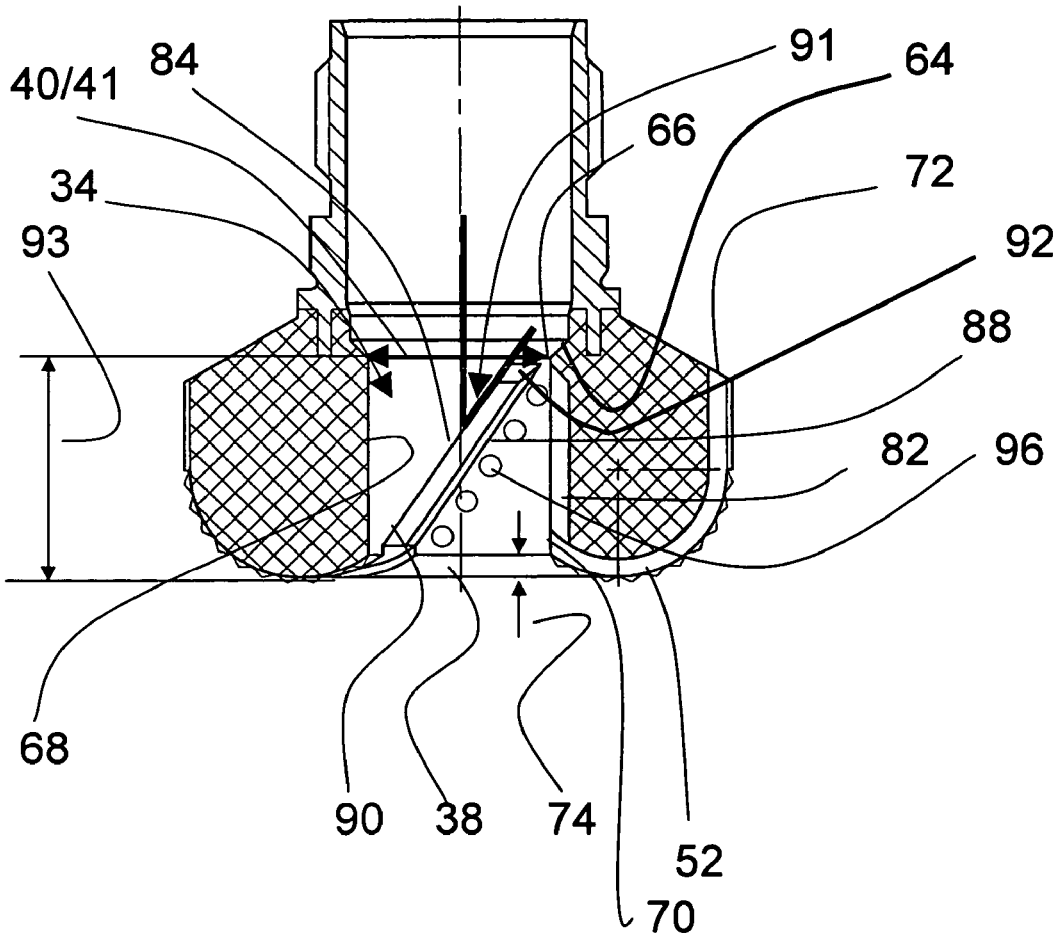
FIG. 4 is the same view as in FIG. 1.

Referring to FIG. 4 which is the same as FIG. 1, at the third annulus (34) top rim (40) is located a projection (64) having an inwardly oriented tip (66). The tip has the effect of reducing the third annulus diameter (41) between the tip (66) and the opposite side of the rim (68) to slightly more than diameter of the core sample so that the core sample passes between them. This diameter (41) is about 10.13 mm and acts as a core gauge for the core that is about 10 mm in diameter in this embodiment. The gauge also ensures that a constant diameter of core sample is produced. The projection (64) also applies tension to the core sample as it slides through the third annulus causing it to separate from the body of rock. A person skilled in the art of geology and rock drilling will understand that during the drilling process the core sample will stress-relieve as it is drilled out. As the core sample passes into the annulus of the drill crown it will be in sliding relation with the projection. The reverse augers have a primary function of promoting the migration of granular material into the junk slot channels. The also assist in grasping the core sample as it is produced and the combined action of the projection and reverse augers act to separate the core from the rock body close to the kerf. The length of the projection (64) can be varied to suit the requirements of the drilling operation. However, the shorter the length of the projection (64) the greater the premature wear of the drill bit and the less the capability of the drill bit to grasp the sample. In this embodiment of our invention, the length of the projection has been optimized.

Referring to FIGS. 2 and 4, each of the radially extending cutting blades (52) has a bottom end (70) and a top end (72). The bottom end (70) extends radially downward and into the third annulus (34) a predetermined distance (74) which is about 1 mm. Each of the radially extending channels (50) has a bottom end (76) and a top end (78). The bottom end (76) of each channel (50) terminates at the bottom rim (38) of the third annulus (34). The diameter of the core sample is determined by the distance (80) (FIG. 2) between the opposite top tips (70) of the cutting blades (52) which is about 10 mm in this embodiment.

Still referring to FIG. 4, within the third annulus (34) a junk slot (82) is formed below the projection (64) and above the tip (70) of cutting blade (52). Junk slot (82) is about 1 mm wide and 9 mm deep and is adapted for collecting cuttings that fall into the third annulus. To remove the cuttings from the third annulus, there is a plurality of radially spaced auger blades (84) fixed to the inside surface of the third annulus (68). Each of these radially spaced auger blades (84) is about 2.1 mm wide has an attacking surface (88), a bottom end (90) and a top end (92). Each of the auger blades (84) is oriented diagonally at an angle (91) across the width of the adjacent radially extending channel (50) and extends about 9.1 mm into the annulus from the bottom rim. The blades are oriented opposite to the direction of rotation of the drill thereby forming a reverse auguring mechanism. Adjacent to each auger blade (84) is a row of evenly spaced abrasive elements (96) parallel to the attacking surface (88) of each auger blade. The abrasive elements may be natural diamonds such as the 75 SPC Kicker grade natural diamonds or synthetic diamonds. When the dry drill bit is rotating, the row of evenly spaced abrasive elements maintains the inside gauge and core sample diameter. The spaced auger blades sweep the cuttings from the third annulus into an adjacent channel (50) for carriage by centrifugal force away from the bit head to the transition zone (54). The efficiency of the reverse auger is dependent upon the angle of attack (91) (being about 55 degrees) of the augur blades and the depth (93) of the blades into the annulus (34). An aggressive angle of attack improves the transfer of cuttings from the annulus to the channels for removal but may cause the drilling bit to stall. A low angle of attack will cause an accumulation of cuttings within the annulus and could also result in drill stall. As well, the depth of the blades will affect the design of the kerf. Our design has optimized the location, depth and attack angle of the reverse augur blades (84) for this embodiment.

A Second Embodiment

Figure 5:
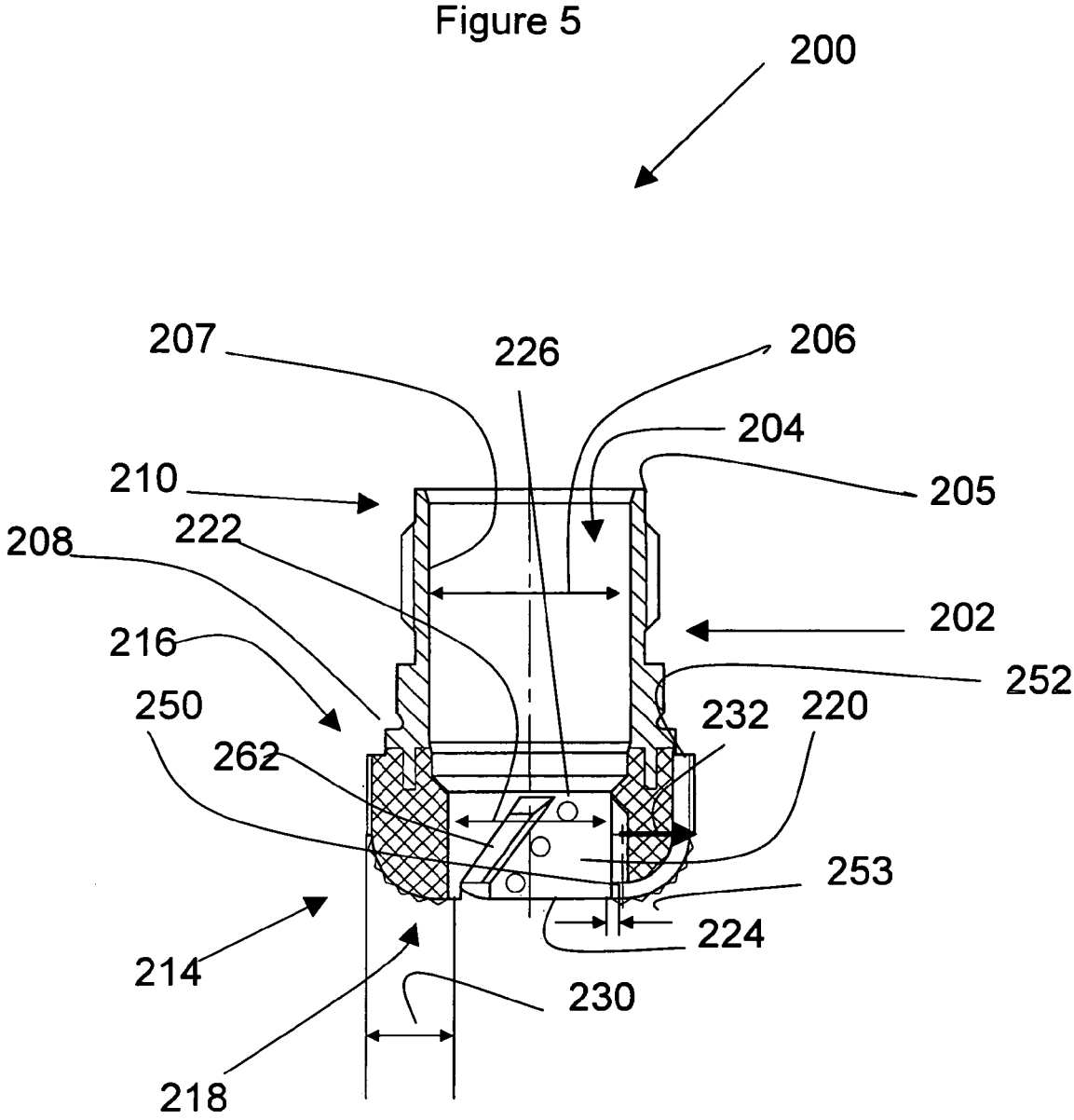
FIG. 5 is a sectional side view of a second embodiment of the invention.

Referring now to FIG. 5, illustrated in cross-sectional view, there is a second embodiment (200) of our drill bit being about 26 mm long and comprising an annular steel body (202) including a first annulus (204), a first inside diameter (206) of about 12.4 mm, a wall (205), an inside surface (207) a bottom end (208) and a top end (210). The top end of the annular steel body is adapted for coupling with a rotatable drill string (not shown) having a second annulus with a second inside diameter. Dimensions provided here are exemplary of one embodiment and these dimensions may vary according to the operational requirements of the drilling project.

The bit crown (214) of this second embodiment has a geometry that is different than the bit crown geometry of the first embodiment illustrated in FIG. 1. The bit crown of the second embodiment is about 20 mm wide and formed using the same hard metal matrix. It is formed onto the bottom end of the annular steel body using a powdered metallurgy process. The bit crown has a top end (216) and a bottom end (218) and comprises a third annulus (220) having a third inside diameter (222) of about 10.13 mm, a bottom rim (224) and a top rim (226). The third annulus (220) extends through the bit crown (214) and is co-axial with the first (204) and second annuli. The third annulus (220) is adapted to receive and pass a 10 mm diameter core sample to the annular steel body first annulus and hence to the drill string second annulus. The bit crown further comprises a bit head (230) or kerf having a radial profile with a radius (232) of about 4 mm for rotatively cutting into the body of rock thereby forming the core sample and creating cuttings.

Figure 6:
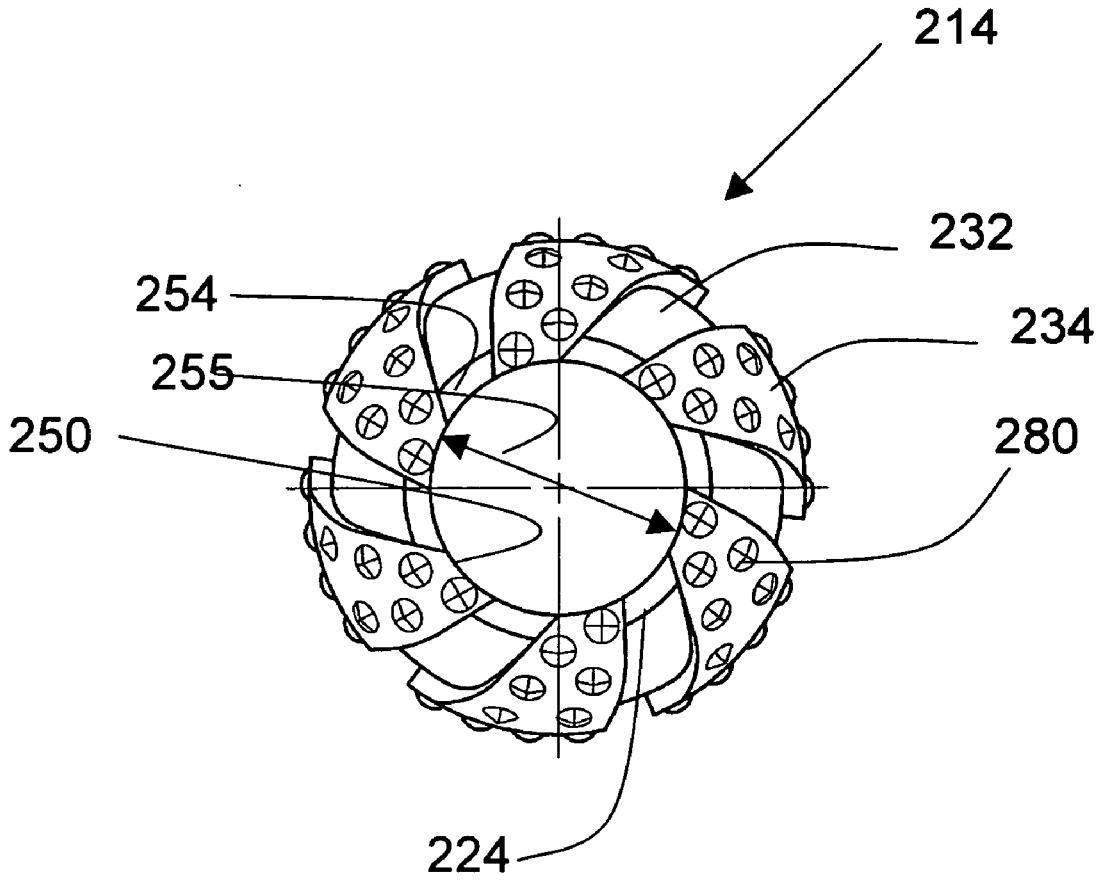
FIG. 6 is a bottom view of a second embodiment of the invention.

Referring now to FIG. 6, there is shown a bottom view of a second embodiment of the invention. Formed within the bit crown (214) is are a plurality of evenly spaced and tapered radially extending channels (232) adapted for carrying the cuttings away from the bit head (230) as more fully explained below. There is also a plurality of evenly spaced tapered radially extending cutting blades (234). Each one of the radially extending cutting blades (234) is separated by one of the channels (232). In the embodiment shown in FIG. 6 there are six cutting blades and six channels but there may be more or fewer of blades and channels in other embodiments.

Figure 7:
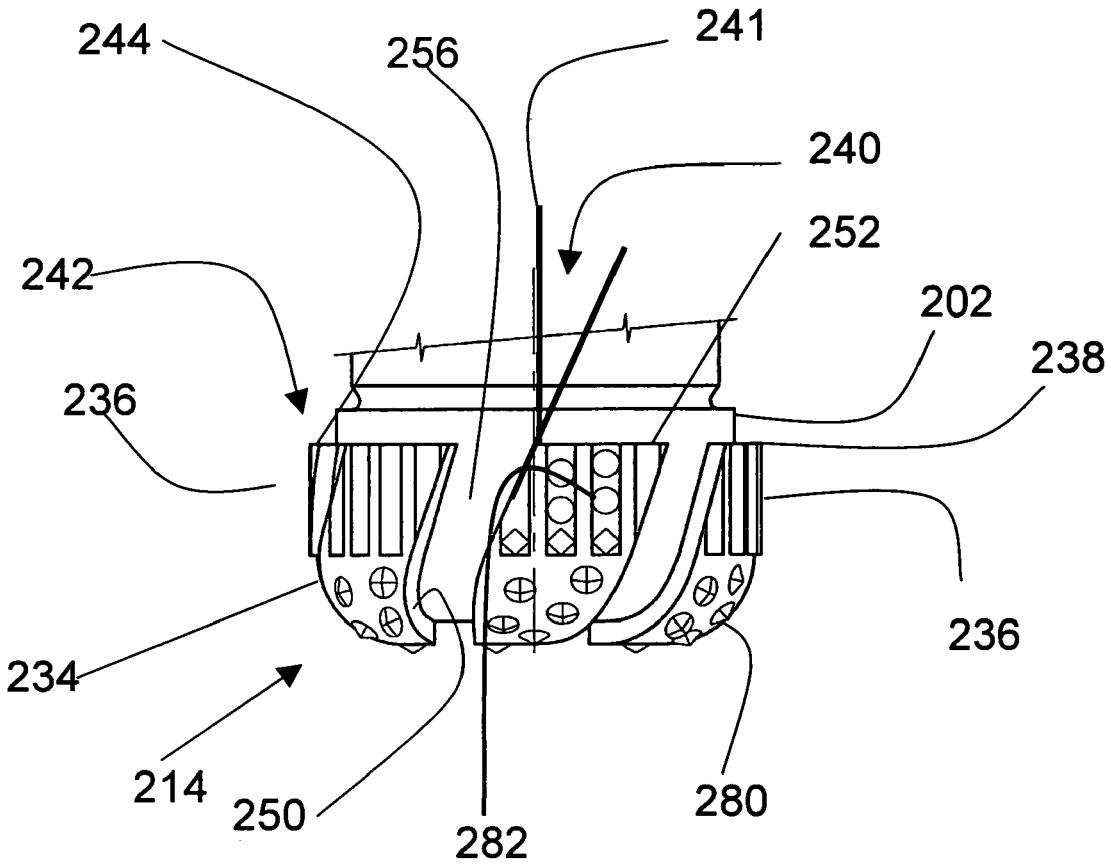
FIG. 7 is an elevation view of a second embodiment of the invention.

Referring now to FIG. 7, there is illustrated a side view of the drill crown (214) of the second embodiment of the invention. Integral to and above each of the cutting blades (234) there is a vertically oriented radial outer face (236) that is about 5 mm high in this embodiment. The outer faces (236) are adapted for stabilizing the bit head against angular deviation and gauging the bore hole. Within each radial outer face (236) there is embedded a plurality of vertically oriented and parallel splines (238). Each outer face deviates at a predetermined angle (240) from the vertical (241). The angle is generally about 24 degrees from the vertical (241) but it can be more or less than 24 degrees.

A transition zone (242) is included above the bit crown and is adapted for receiving the cuttings from the channels (232) and transported to the drill string auger means for removal. The transitional zone is not integral to the bit crown of the second embodiment. It comprises a first horizontal surface (244) extending across the top of the face to the bottom outside surface of the annular steel body (202).

Figure 8:
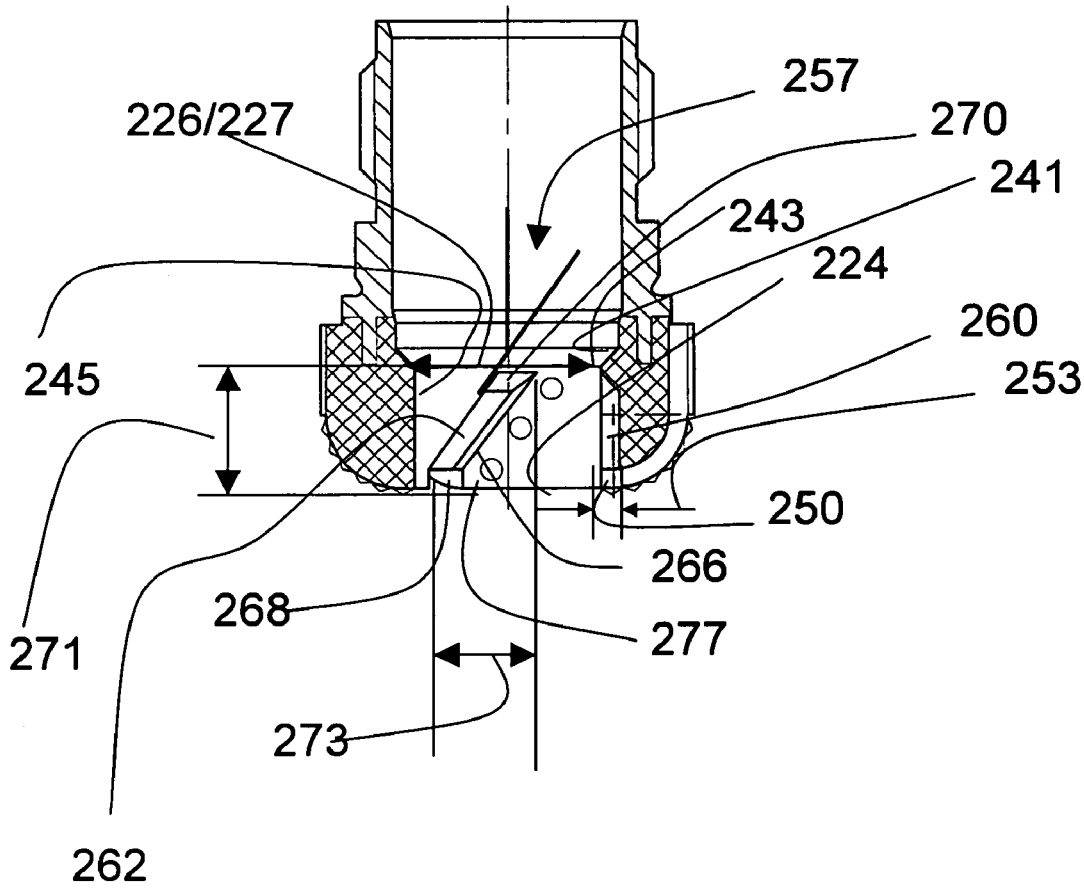
FIG. 8 is the same view as FIG. 5.

Refer now to FIG. 8 which is identical to FIG. 5. At the third annulus top rim (226) is located a projection (241) having a length and an inwardly oriented tip (243) extending a predetermined distance into the third annulus thereby reducing the third annulus top rim (226) diameter (227) from the tip (243) to the opposite side (245) of the rim to slightly greater than the diameter of the core sample (about 10.13 mm in this embodiment) so that the core sample (about 10 mm in diameter in this embodiment) may pass through. The projection (243) is in sliding contact with the core sample, applies tension to the core sample and causes it to separate from the body of rock. The projection (243) also gauges the diameter of the core sample.

Referring to FIGS. 5, 6 and 7, each of tapered radially extending cutting blades (234) has a bottom end (250) and a top end (252). The bottom end extends horizontally across a portion of the third annulus a predetermine distance (253). Similarly, each tapered radially extending channel (232) has a bottom end or inlet (254) (about 2.5 mm wide in this embodiment) and a top end or outlet (256) (about 4.6 mm wide in this embodiment). The channel bottom end terminates at the bottom rim (224). The diameter of the core sample is determined by the distance (255) between the opposite top ends (250) of the tapered radially extending cutting blades (about 10 mm in this embodiment).

Referring back to FIG. 8, a junk slot (260) (about 1 mm wide and 5 mm deep in this embodiment) is formed below the projection (241) and between the projection (241) and the bottom end of the adjacent cutting blade (250). The junk slot adapted for collecting cuttings within the third aperture. The rotating dry drilling bit further includes means for removing cuttings from the third aperture. These means comprises a plurality of radially spaced auger blades (262) diagonally oriented at a predetermined angle (257) of about 55 degrees counter-rotationally and fixed to the inside surface (245) of the third annulus. Each of the radially spaced auger blades has an attacking surface (266), a bottom end (268) and a top end (270). In this embodiment, the auger blade is about 2 mm wide and has a diagonal length of about 5.1 mm. The bottom end (268) of each of the radially spaced auger blades terminates at the bottom rim (224) of the third annulus. The auger blades are diagonally oriented in the opposite direction of rotation. The blades have an angle of attack (257) and a depth (271) into the annulus. Generally, each blade extends horizontally a distance (273) of about 5 mm along the inside wall of the annulus. Adjacent to each auger blade are abrasive elements comprising a row of either natural diamonds such as 75 SPC Kicker grade natural diamonds or synthetic diamonds.

In operation, as the dry drill bit is rotating, the row of evenly spaced abrasive elements (277) maintain the inside gauge and core sample diameter. The radially spaced auger elements sweep the cuttings from the third annulus into an adjacent channel for carriage by centrifugal force away from the bit head.

Referring to FIG. 7, a plurality of abrasive elements (280) is embedded into each cutting blade surface. In one embodiment of the invention the abrasive elements comprise natural diamonds such as 50 SPC AAAA grade natural diamonds. These diamonds provide a relief of about 0.3 mm above the surface of the cutting blade. In another embodiment of the invention the abrasive elements comprises synthetic diamonds. In yet another embodiment of the invention the abrasive elements comprise natural diamonds such as 50SPC AAAA grade natural diamonds and synthetic diamond crystals impregnated into the volume of the bit crown. The synthetic diamonds are thermally stable polycrystalline diamond elements plus synthetic diamond crystals. 75SPC Kicker grade natural diamonds or alternatively, synthetic diamonds is also inserted into each of the surfaces of each of the splines.

A Third embodiment

Figure 9:
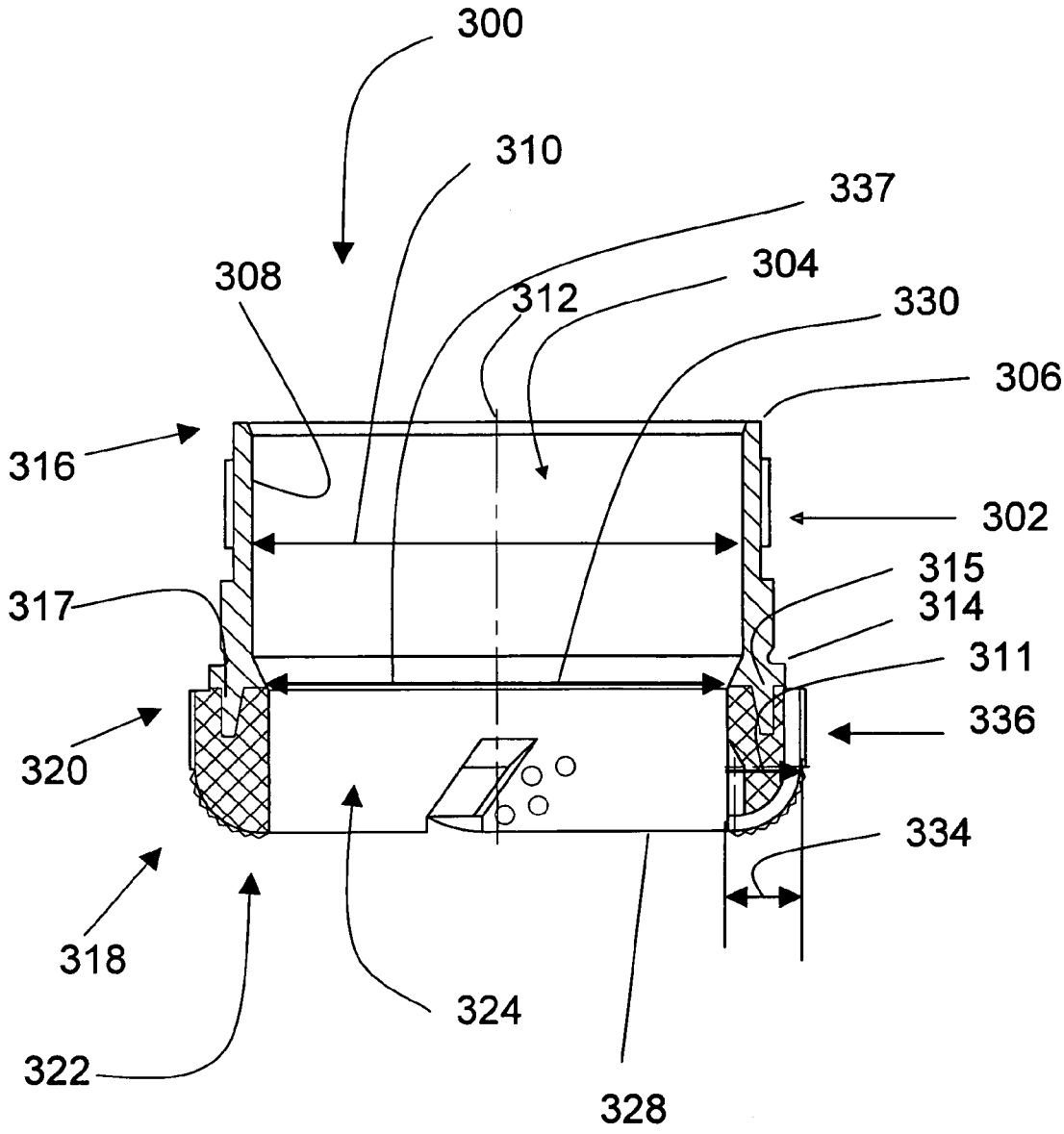
FIG. 9 is a cross-sectional side view of a third embodiment of the invention.

Referring now to FIG. 9, there is shown in cross-section a third embodiment of our invention identified generally as (300). The rotating dry drilling bit of this embodiment is about 26 mm long and comprises an annular steel body (302) having a first annulus (304), a cylindrical wall (306) having an inner surface (308), an inside diameter (310) of about 29 mm, an axis (312), a bottom end (314) and a top end (316). The top end (316) of the annular steel body (302) is adapted for coupling with a co-axial rotatable drill string not shown in this diagram. The drill string has a second annulus with a second inside diameter equal to inside diameter (310). There is a co-axial bit crown shown generally as (318) is about 37 mm wide and mounted to the annular steel body bottom end (314) over integral anchoring elements (315) and (317). As shown in this FIG. 9, the geometry of the bit crown of the third embodiment of our invention is different from the first and second embodiments.

In this third embodiment, the bit crown has a top end (320) and a bottom end (322) and comprises a third annulus (324) having a third inside diameter (337) of about 28 mm, a bottom rim (328) and a top rim (330). The third annulus (324) extends through the bit crown and is generally co-axial with the first (304) and second annuli. The third annulus (324) is further adapted to receive and pass the core sample to the annular steel body first annulus (304) and hence to the drill string second annulus. The radius (311) of the bit crown is about 4 mm and determines the amount of point loading on the bit head. The radius of bit crown in this embodiment ensures that a high loading is achieved on the bit head to commence the core as well as encouraging cuttings to exit through the channels away from the drill head. There is a bit head or kerf (334) having a radial profile of radius (311) for rotatively cutting into the body of rock thereby forming the core sample and creating cuttings.

The bit crown includes a plurality of radial outer faces (336). The radial outer faces (336) have a vertical profile, are about 5 mm high and are adapted for stabilizing the bit head against angular deviation as well as gauging the annular bore hole.

Figure 10:
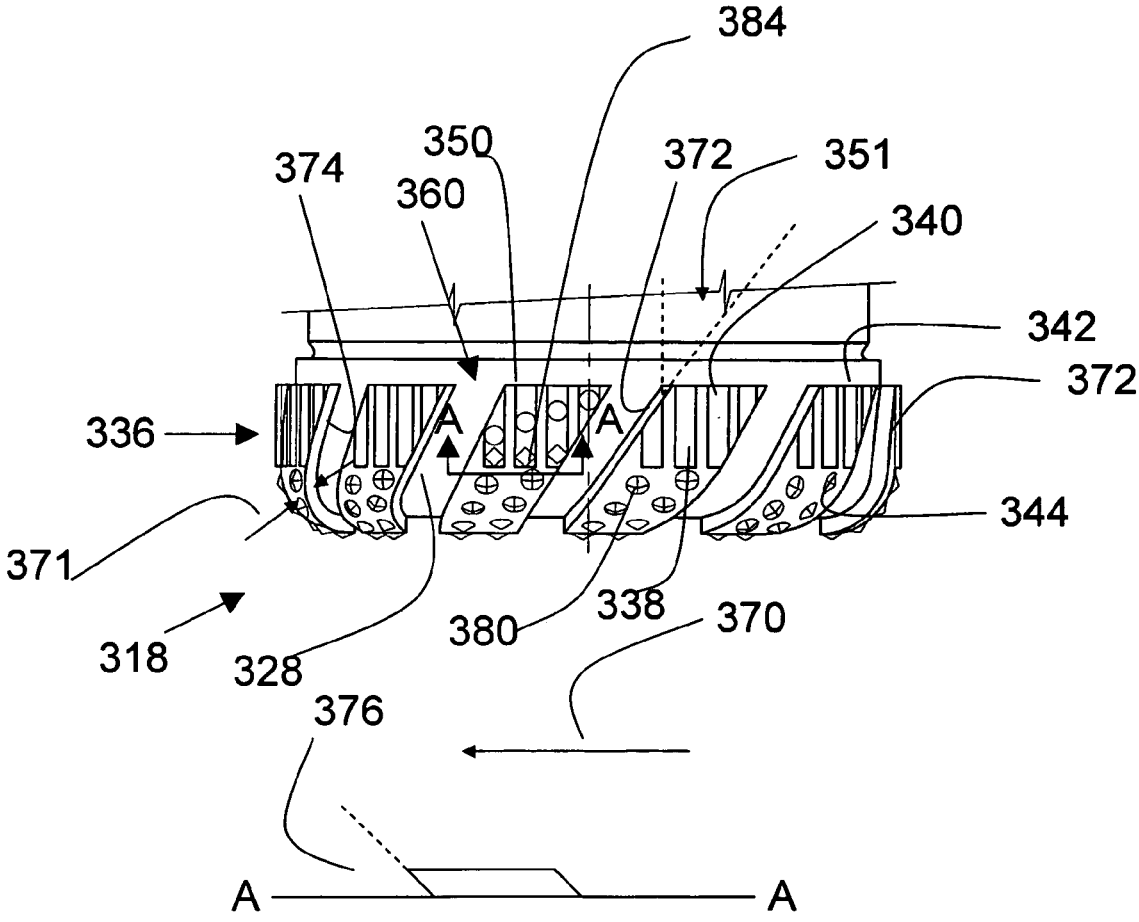
FIG. 10 is a bottom view of a third embodiment of the invention.

Referring now to FIG. 10, there is shown, in side view, the crown bit (314). Within each of the radial outer faces (336) there is embedded a plurality of vertically oriented and parallel splines (338). Each of the splines has a surface (340), a top end (342) and a bottom end (344).

Figure 11:
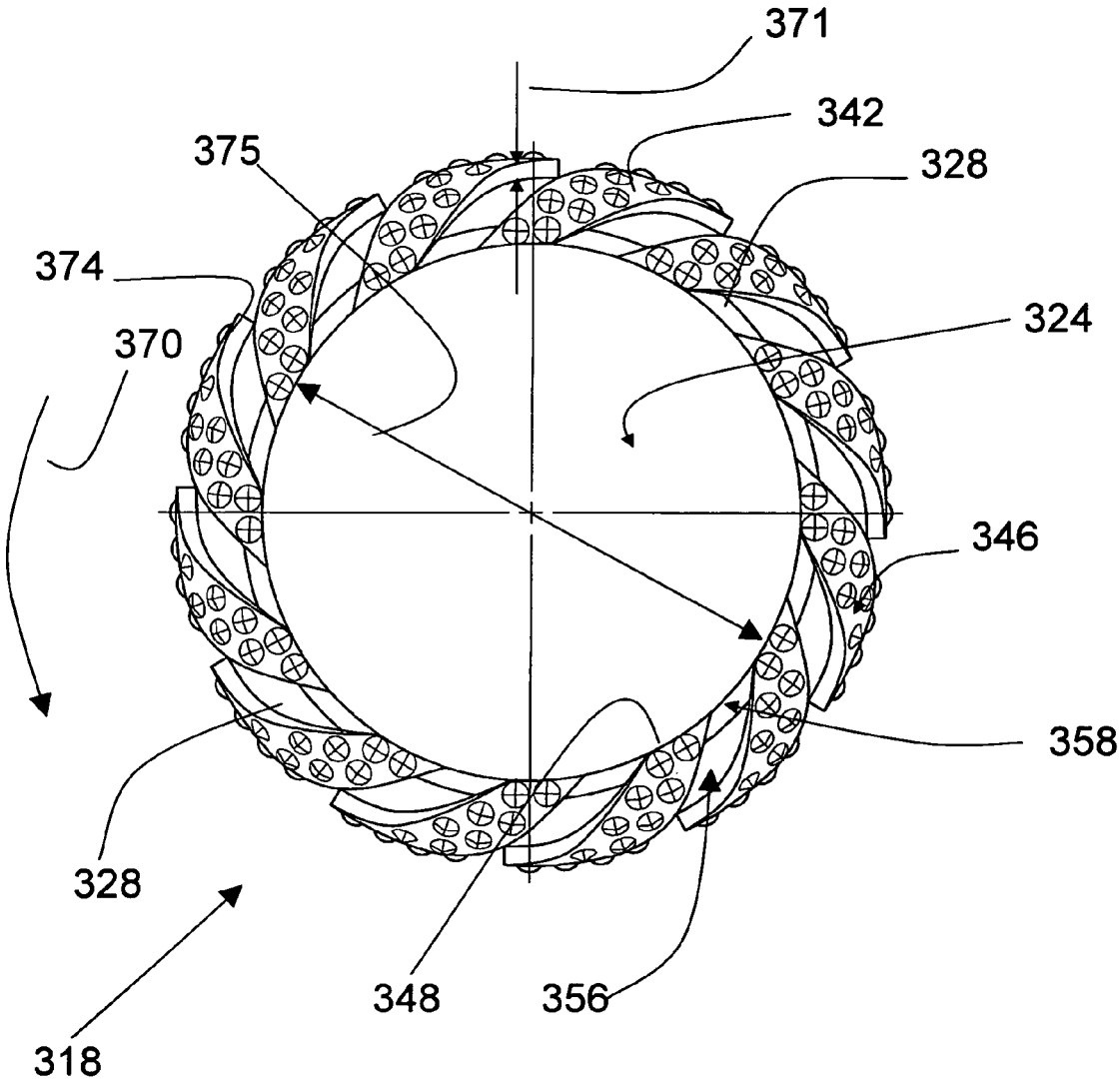
FIG. 11 is an elevation view of a third embodiment of the invention.

Referring now to FIG. 11, there is shown a bottom view of the bit crown (318) of this third embodiment showing the bottom rim (328) of third annulus (324). Formed within the within the bit crown (328) there is a plurality of evenly spaced radially extending channels (340) adapted for carrying cuttings away from the bit head (324) by centrifugal force as the drill bit rotates. As well the bit crown (318) has a plurality of evenly spaced radially extending cutting blades (342). Each one of the radially extending cutting blades (342) is separated by one of the radially extending channels (340). In the embodiment illustrated in FIG. 11 there are 12 cutting blades and 12 channels although there may be more or less.

Referring to FIGS. 10 and 11, each radially extending cutting blade (342) has a blade surface area generally indicated at (346). Each blade has a slightly diminishing tapered width from the bottom end (348) of the blade to the top end (350) of the blade. The amount of the blade taper is much less than the previous two embodiments and may be as small as a few millimeters between the top and bottom of the blade. As well, each radially extending channel (340) has a channel surface area generally shown as (356) and an increasing tapered width of about 2.5 mm from the top end or inlet (358) of the channel to about 3.8 mm at the bottom end (360) or outlet of the channel. The amount of the taper from bottom to top end of the channel may be as small as 1.3 mm. In this embodiment, the surface area (346) of each blade (342) is slightly less than the surface area (356) of each channel (328) but this is not always the case.

As shown in FIG. 10, each radially extending cutting blade (342) and each radially extending channel (328) has a diagonal orientation at an angle (351) of about 35 degrees conforming to the direction of rotation (370) of the rotating dry drill bit. This angle may be more or less than 35 degrees. This diagonal configuration promotes the augering action of the drill bit to remove cuttings away from the drill head.

Referring now to FIGS. 10 and 11, each blade surface (346) is raised above each channel surface (356) a distance (371) of about 1 mm thereby creating blade surface opposite side walls comprising a blade surface leading side wall (372) and a blade surface lagging side wall (374). The blade surface leading side wall (372) and the blade surface lagging side wall (374) are angled at a predetermined angle (376) of about 35 degrees towards the direction of rotation of the dry drilling bit (370) as shown in FIG. 10 Section, A-A. This angle may be more or less than 35 degrees. A plurality of abrasive elements (380) is embedded into the blade surface. In one embodiment of the invention the abrasive elements comprise natural diamonds such as 50 SPC AAAA grade natural diamonds plus synthetic diamond crystals impregnated into the volume of the bit crown. In another embodiment of the invention the abrasive elements comprises synthetic diamonds comprising thermally stable polycrystalline diamond elements plus synthetic diamond crystals impregnated into the volume of the bit crown. A row comprising a combination abrasive elements (382) 75 SPC Kicker grade natural diamonds and (384) 75 AAAA grade natural diamonds or, alternatively, synthetic diamonds is also inserted into each of the radial surface of each of the splines.

Figure 12:
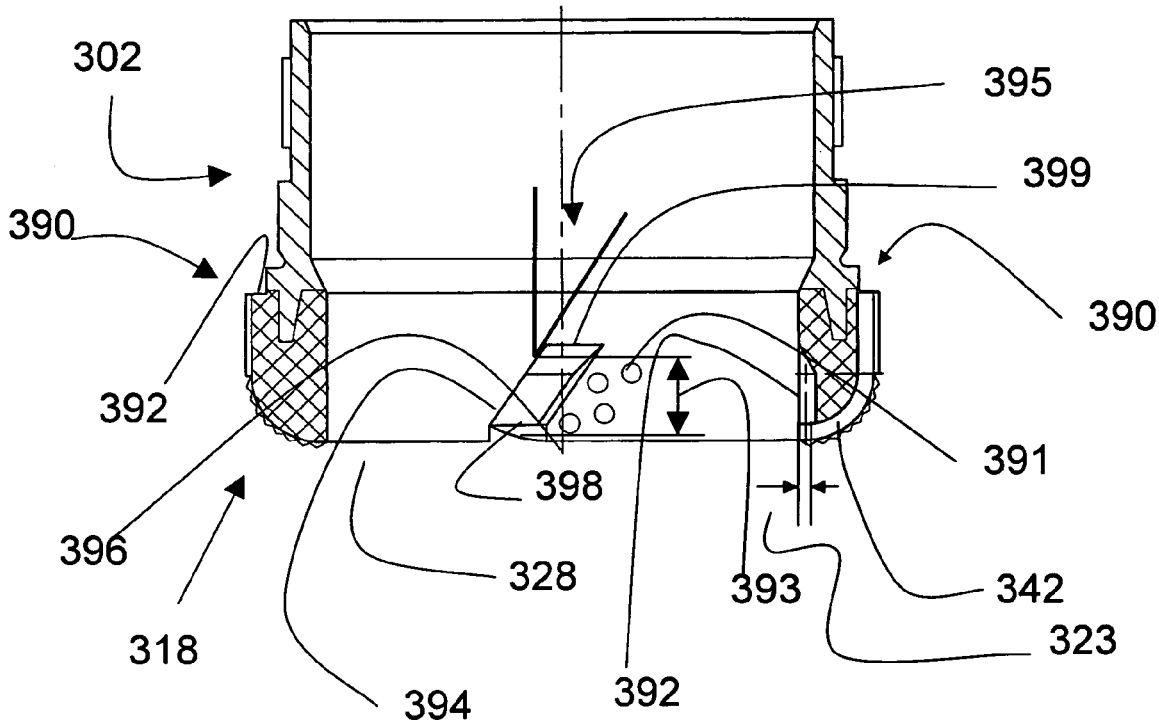
FIG. 12 is the same view as FIG. 9.

Referring to FIG. 12, there is a transition zone (390) that is adapted for receiving the cuttings from the plurality of channels and then transporting them to an auguring means located above the drill bit on the drill string. The transition zone (390) is located above the bit crown (318) and comprises a horizontal surface (392) extending to the surface of the annular steel body (302). The transitional zone receives cuttings from the channels and transfers them to an auguring means located above the transitional zone for transport out of the bore hole.

Referring to FIGS. 11 and 12, each of the radially extending cutting blades (342) bottom ends (348) extend horizontally into the third annulus (324) a predetermine distance (323) of about 1 mm. The diameter of the core sample is determined by the distance (375) between the opposite top ends (348) of the cutting blades (342) which is about 28 mm.

Within the third annulus (324) a junk slot (392) is formed within the inside surface of the third annulus below the tip (348) of cutting blade (342). Junk slot (392) is about 1 mm wide and 4.5 mm deep and is adapted for collecting cuttings that collect within the third annulus. To remove the cuttings from the third annulus, there is a plurality of radially spaced auger blades (394) having a reverse diagonal orientation at an angle (395) and fixed to the inside surface of the third annulus (324). The blades are about 2 mm wide and have a diagonal length of about 4.8 mm. In this embodiment there are 12 such augur blades. Each of these radially spaced auger blades (394) has an attacking surface (396), a bottom end (398) and a top end (399). Each of the bottom ends (398) of the radially spaced auger blades (394) is generally situated midway across an adjacent channel (340) and extends a depth (393) from bottom rim (328) into the third annulus. These blades form a reverse auguring mechanism. Adjacent to each auger blade (394) attacking surface (396) is a plurality of abrasive elements (391) generally comprising either 75 SPC Kicker grade natural diamonds or synthetic diamonds. When the dry drill bit is rotating, the abrasive elements maintain the inside gauge and the core diameter. The spaced auger blades sweep the cuttings from the third annulus into an adjacent channel for carriage by centrifugal force away from the bit head. In this third embodiment the angle of attack (395) is 55 degrees from the vertical. The angle may be more or less than 55 degrees. The depth (393)

of the augur blades in this third embodiment is about 4.8 mm and does not extend through the third annulus.

Embedded into the surface of each cutting blade (342) is a plurality of abrasive elements generally comprising natural 50 SPC AAAA grade diamonds plus synthetic diamond crystals impregnated into the volume of the bit crown. In another embodiment the diamonds can be synthetic diamonds comprising thermally stable polycrystalline diamond elements plus diamond crystals impregnated into the volume of the bit crown. Embedded into the surface of the vertical splines (338) is a combination of diamonds comprising of 75 SPC AAAA grade natural diamonds and 75 SPC Kicker grade natural diamonds or synthetic diamonds.

A Fourth Embodiment

Figure 13:
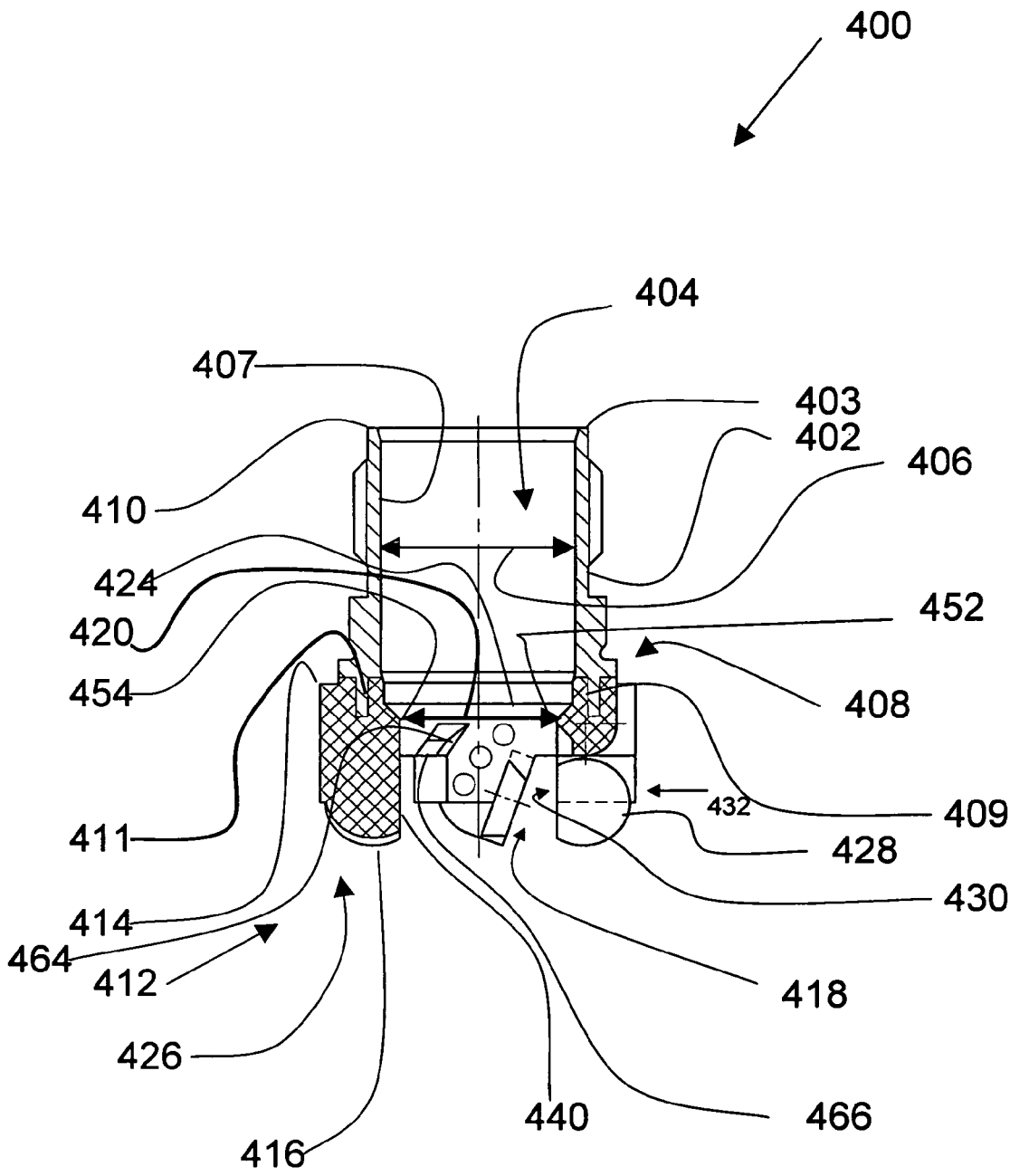
FIG. 13 is a cross-sectional side view of a fourth embodiment of the invention.
Figure 14:
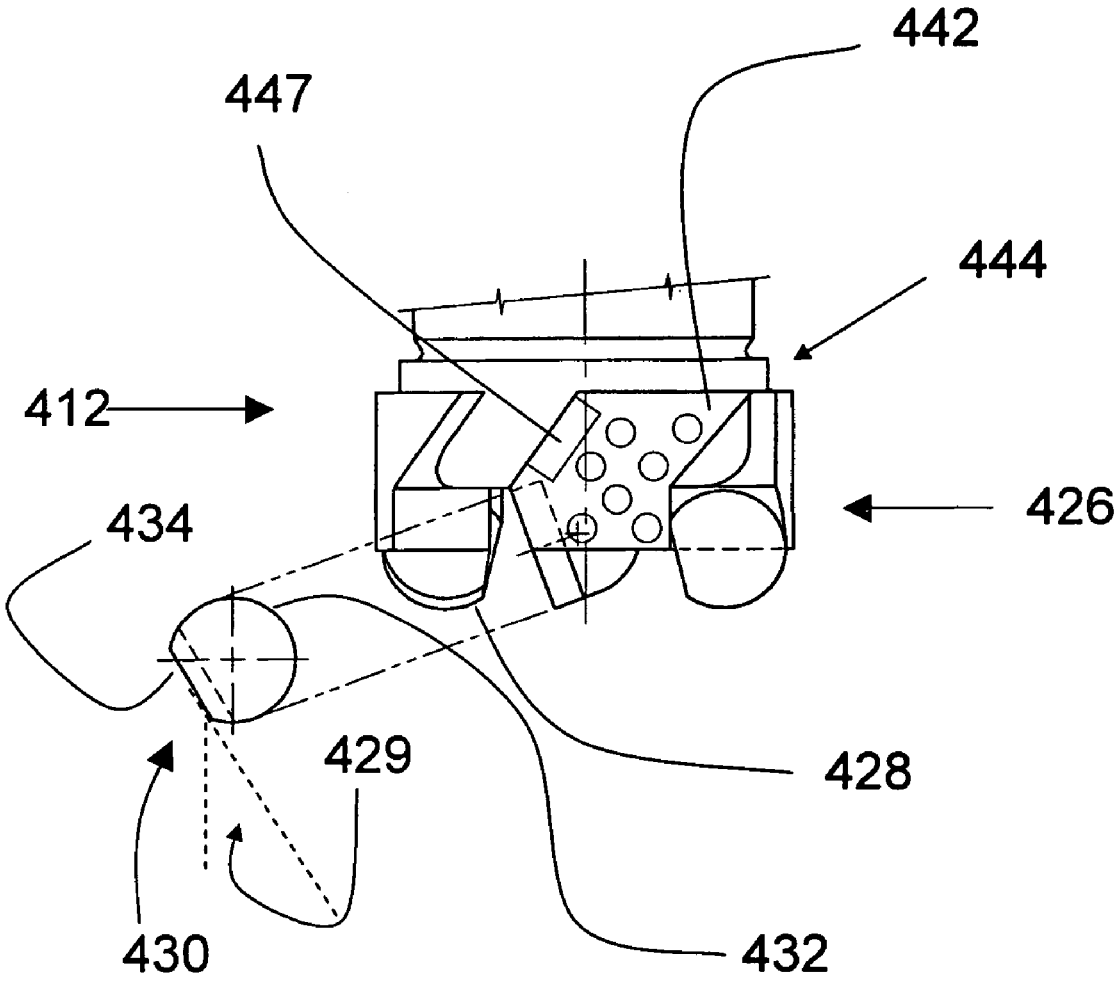
FIG. 14 is an elevation view of a fourth embodiment of the invention.
Figure 15:
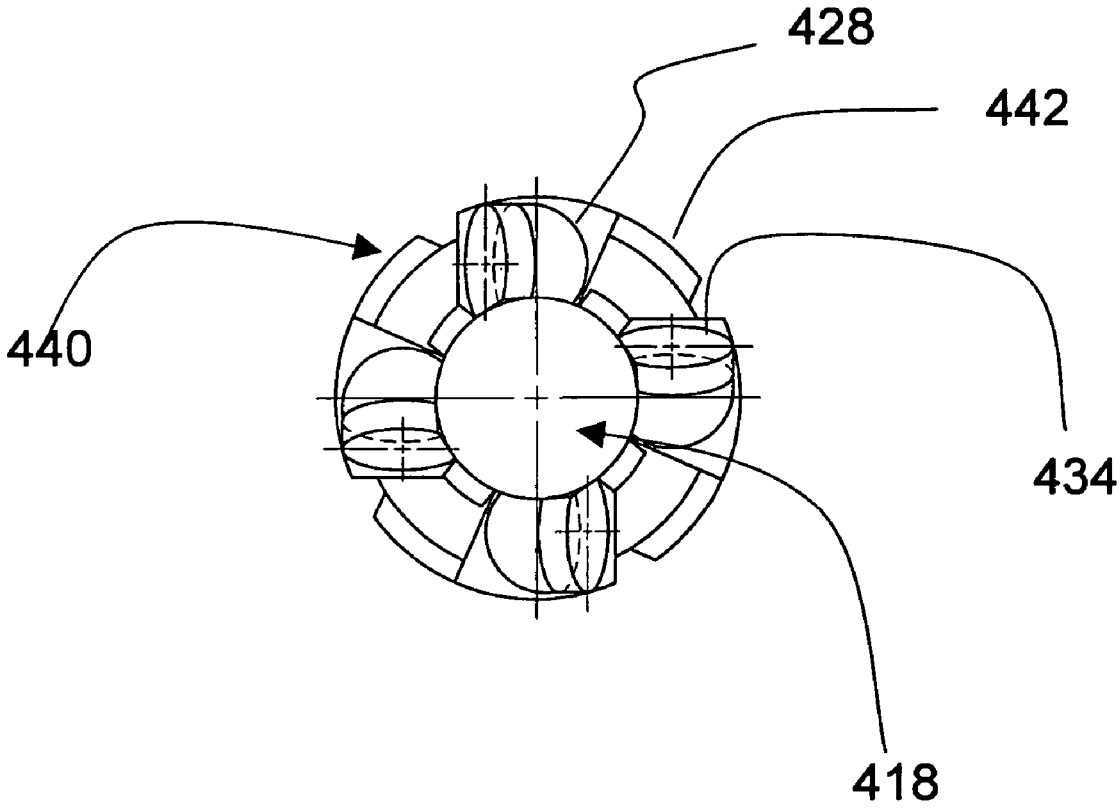
FIG. 15 is a bottom view of a fourth embodiment of the invention.

Referring to FIGS. 13, 14 and 15 there is shown a fourth embodiment of our invention. In this embodiment the drill bit (400) is about 27 mm long. The dry drill bit comprises an annular steel body (402) having a first annulus (404), a wall (403), a first inside diameter (406) of about 12.4 mm, an inside surface (403), a bottom end (408) and a top end (410). The top end (410) adapted for coupling with a rotatable drill string having a second annulus with a second inside diameter. There is a bit crown (412) about 20 mm wide comprising a hard metal matrix formed onto the bottom end of the annular steel body on anchoring elements (409) and (411) using a powdered metallurgy process. The bit crown (412) has a top end (414) and a bottom end (416) and comprises a third annulus (418) having a third inside diameter (420) of about 10 mm and a top rim (424). The third annulus extends through the bit crown and is co-axial with the first (404) and second annuli and adapted to receive and pass the core sample to the annular steel body first annulus and hence to the drill string second annulus. There is also included a bit head (426) comprising a plurality of thermally stable polycrystalline diamond cutting elements (428) for rotatively cutting into the body of rock thereby forming the core sample and creating cuttings. Each of the cutting elements (428) has a cylindrical shape having a diameter of about 6 mm and a thickness of about 1.5 mm and comprising a flat attacking face (430) and a convex lagging face (432). The attacking face has a cutting edge (434) which will engage the body of rock about its entire circumference. The cutting elements are oriented at a rake angle (429) of about 20 degrees so that each attacking face (430) cutting edge (434) is angled to attack the body of rock. The cutting elements are oriented at 90 degrees to each other around the circumference of the bit.

Between each of the cutting elements there is an opening (440) adapted to remove cuttings away from the bit head. The opening is oriented at a diagonal of about 35 degrees from the vertical axis. The bit crown further includes a plurality of radial outer faces (442). Each of the radial outer faces (442) is integral to the bit crown and located above each of the cutting elements (428). The outer faces are adapted for stabilizing the bit head against angular deviation and gauging said bore hole. Each of the outer faces has embedded within it a plurality of 50 SPC Kicker grade natural diamonds. Also embedded within each outer face is a 1.5 mm by 1.5 mm thermally stable polycrystalline diamond cutting element (447). The drill bit also includes a transition zone (444) adapted for receiving the cuttings from the openings for transport away from the bit crown.

At the third annulus top rim (424) is located a projection (450) having a length and an inwardly oriented tip (452) extending a predetermined distance into the third annulus thereby reducing the third annulus diameter to 10.13 mm from the tip (452) to the opposite side (454) of the rim which is slightly wider than the diameter of the core sample. The projection is in sliding contact with the core sample, applies tension to the core sample thereby causing it to separate from the body of rock and gauges the core sample.

To remove the cuttings from the third annulus, there is a plurality of radially spaced auger blades (460) having a reverse diagonal orientation at an angle (462) of about 55 degrees (464) and fixed to the inside surface of the third annulus. The blades are about 2 mm wide and have a diagonal length of about 2 mm. In this embodiment there are 4 such auger blades. Each of these radially spaced auger blades has an attacking surface (464), a bottom end (466) and a top end (468). Each auger blade extends a depth (470) of about 2 mm into the third annulus. These blades form a reverse auguring mechanism. Adjacent to each auger blade attacking surface is a plurality of abrasive elements (472) generally comprising either 50 SPC Kicker grade natural diamonds or synthetic diamonds. When the dry drill bit is rotating, the abrasive elements maintain the inside gauge and the diameter of the core. The spaced auger blades sweep the cuttings from the third annulus into an adjacent channel for carriage by centrifugal force away from the bit head.

It is apparent from the foregoing description that the present invention and its preferred embodiments are improvements over the known art and meet the objectives set forth herein.

Although this description contains much specificity, these should not be construed as limiting the scope of the invention by merely providing illustrations of some of the embodiments of the invention. Thus the scope of the invention should be determined by the appended claims and their legal equivalents rather than by the examples given.

We claim:

1. A rotating dry drilling bit for drilling an annular bore hole into a body of rock and obtaining a core sample from said body of rock, said rotating dry drilling bit comprising:

a. an annular steel body having a first annulus, a first inside diameter, a bottom end and a top end, said top end adapted for coupling with a rotating drill string, said drill string having an second annulus with a second inside diameter;

b. a bit crown mounted to said annular steel body bottom end, wherein said bit crown has a top end and a bottom end and comprises:

i. a third annulus having a third inside diameter, a bottom rim and a top rim, said third annulus extending through said bit crown, wherein the third annulus is co-axial with said first and second annuli and adapted to receive and pass said core sample to the annular steel body first annulus and hence to the drill string second annulus;

ii. a bit head having a radial profile for rotatively cutting into said body of rock thereby forming the core sample and creating cuttings;

iii. a radial outer face integral to and above said bit head, said radial outer face having a vertical profile and adapted for stabilizing the bit head against angular deviation and gauging said annular bore hole;

iv. a plurality of radially extending channels formed therein and evenly spaced thereabout and adapted for carrying said cuttings away from the bit head;

v. a plurality of radially extending cutting blades formed therein and evenly spaced thereabout wherein each one of said plurality of radially extending cutting blades is separated by one of said plurality of radially extending channels; and, c. a transition zone adapted for receiving the cuttings from the plurality of channels.

2. The dry drilling bit as claimed in claim 1, wherein said annular steel body is machined from C12L14 steel.

3. The dry drilling bit as claimed in claim 2 wherein the bit crown is a hard metal matrix formed onto the bottom end of the annular steel body using a powdered metallurgy process.

4. The dry drilling bit as claimed in claim 3, wherein the radial outer face includes a plurality of vertically oriented and parallel splines embedded therein, each of said splines having a radial surface.

5. The dry drilling bit as claimed in claim 4, wherein said third annulus top rim is characterized by a projection having a inwardly oriented tip thereby defining the third annulus top rim diameter from said tip to the opposite side of the rim to the diameter of the core sample.

6. The rotating dry drilling bit as claimed in claim 5, wherein said projection applies tension to the core sample causing it to separate from the body of rock.

7. The rotating dry drilling bit as claimed in claim 6, wherein each radially extending cutting blade of said plurality of radially extending cutting blades has a bottom tip and a top tip, and wherein first bottom tip extends radially downward into the third annulus a predetermine distance.

8. The rotating dry drilling bit as claimed in claim 7, wherein each radially extending channel of said plurality of radially extending channels has a bottom tip and a top tip, and wherein said channel bottom tip terminates at said bottom rim.

9. The rotating dry drilling bit as claimed in claim 8, wherein a junk pocket is formed above the projection and between the projection and the bottom of the adjacent radially extending cutting blade, said junk pocket adapted for collecting cuttings within the third aperture.

10. The rotating dry drilling bit as claimed in claim 9 further including means for removing cuttings from the third aperture.

11. The rotating dry drilling bit as claimed in claim 10, wherein said means for removing cuttings comprises:

a. a plurality of radially spaced auger blades fixed to the bottom inside surface of the third annulus, wherein each of said plurality of radially spaced auger blades has an attacking surface, a bottom end and a top end, and further wherein the bottom end of each of said plurality of radially spaced auger blades is adjacent to a corresponding bottom tip of each of said plurality of radially extending cutting blades, and wherein each auger blade of said plurality of radially spaced auger blades is oriented diagonally across the width of each radially extending channel of said plurality of radially extending channels; and, b. a row of evenly spaced abrasive elements adjacent and parallel to the attacking surface of each blade of said plurality of radially spaced auger blades;

so that in operation, as the dry drill bit is rotating, the auger blades sweep the cuttings from the third annulus into an adjacent radially extending channel for carriage by centrifugal force away from the bit head.

12. The rotating dry drilling bit as claimed in claim 11, wherein each radially extending cutting blade of the plurality of radially extending cutting blades has a blade surface area diminishing tapered width from the bottom tip to the top tip thereof.

13. The rotating dry drilling bit as claimed in claim 12, wherein each radially extending channel of the plurality of radially extending channels has a channel surface area and a diminishing tapered width from the top tip to the bottom tip thereof.

14. The rotating dry drilling bit as claimed in claim 13, wherein each radially extending cutting blade of the plurality of radially extending cutting blades and each radially extending channel of the plurality of radially extending channels have a diagonal orientation conforming to the direction of rotation of the rotating dry drill bit.

15. The rotating dry drilling bit as claimed in claim 14, wherein said blade surface is raised above the channel surface thereby creating blade surface opposite side walls comprising a blade surface leading side wall and a blade surface lagging side wall.

16. The rotating dry drilling bit as claimed in claim 15, wherein said blade surface leading side wall and said blade surface lagging side wall are angled at a predetermined angle towards the direction of rotation of the dry drilling bit.

17. The rotating dry drilling bit as claimed in claim 16, wherein a plurality of abrasive elements is inserted into the blade surface.

18. The rotating dry drilling bit as claimed in claim 17, wherein said plurality of abrasive elements comprise natural diamonds.

19. The rotating dry drilling bit as claimed in claim 17, wherein said plurality of abrasive elements comprises synthetic diamonds.

20. The rotating dry drilling bit as claimed in claim 17, wherein the plurality of abrasive elements comprises a combination of natural and synthetic diamonds.

21. The rotating dry drilling bit as claimed in claim 17, wherein a row of abrasive elements is inserted into said radial surface of each of said splines.

22. A rotating dry drilling bit for drilling an annular bore hole into a body of rock and obtaining a core sample from said body of rock, said rotating dry drill bit comprising:

a. an annular steel body having a first annulus, a first inside diameter, a bottom end and a top end, said top end adapted for coupling with a rotating drill string, said drill string having an second annulus with a second inside diameter;

b. a bit crown comprising a hard metal matrix formed onto said bottom end of said annular steel body using a powdered metallurgy process, wherein said bit crown has a top end and a bottom end and comprises:

i. a third annulus having a third inside diameter, a bottom rim and a top rim, said third annulus extending through said bit crown, wherein the third annulus is co-axial with said first and second annuli and adapted to receive and pass said core sample to the annular steel body first annulus and hence to the drill string second annulus;

ii. a bit head having a radial profile for rotatively cutting into the body of rock thereby forming the core sample and creating cuttings;

iii. a plurality of tapered radially extending channels formed therein and evenly spaced thereabout and adapted for carrying said cuttings away from the bit head;

iv. a plurality of tapered radially extending cutting blades formed therein and evenly spaced thereabout wherein each one of said plurality of radially extending cutting blades is separated by one of said plurality of radially extending channels; and, v. a plurality of radial outer faces adjacent to and above said bit head, wherein:

1. each radial outer face of said plurality of radial outer faces is integral to an adjacent radially extending cutting blade;
2. the plurality of radial outer faces is adapted for stabilizing the bit head against angular deviation and gauging said bore hole;
3. each radial outer face of said plurality of radial outer faces comprises a plurality of vertically oriented and parallel splines embedded therein;
4. each radial outer face of said plurality of radial outer faces-deviates a predetermined angle from its adjacent tapered radially extending cutting blade; and, c. a transition zone adapted for receiving the cuttings from the plurality of tapered radially extending channels, wherein said transitional zone is integral to and above the bit crown and comprises a vertical surface extending at a predetermined angle from the top of the radial outer face to the surface of the annular steel body, so that the transitional zone receives cuttings from the plurality of channels and transfers them to an auguring means located above the transitional zone for transport out of the bore hole.

23. The dry drilling bit as claimed in claim 22, wherein said third annulus top rim is characterized by a projection having a variable length and an inwardly oriented tip extending a predetermined distance into the third annulus thereby reducing the third annulus top rim diameter from said tip to the opposite side of the rim to the diameter of the core sample, wherein said projection is in sliding contact with the core sample, applies tension to the core sample thereby causing it to separate from the body of rock and gauges the core sample.

24. The rotating dry drilling bit as claimed in claim 23, wherein each tapered radially extending cutting blade of said plurality of tapered radially extending cutting blades has a first bottom tip and a second top tip, and wherein said first bottom tip extends horizontally across the third annulus a distance equal to said predetermine distance.

25. The rotating dry drilling bit as claimed in claim 24, wherein each tapered radially extending channel of said plurality of tapered radially extending channels has a bottom tip and a top tip, and wherein said channel bottom tip terminates at said bottom rim.

26. The rotating dry drilling bit as claimed in claim 25, wherein the diameter of the core sample is determined by the distance between the opposite top tips of the plurality of tapered radially extending cutting blades.

27. The rotating dry drilling bit as claimed in claim 26, wherein a junk pocket is formed above the projection and between the projection and the bottom of the adjacent tapered radially extending cutting blade, said junk pocket adapted for collecting cuttings within the third aperture.

28. The rotating dry drilling bit as claimed in claim 27 further including means for removing cuttings from the third aperture.

29. The rotating dry drilling bit as claimed in claim 28, wherein said means for removing cuttings from the third aperture comprises:

a. a plurality of radially spaced auger blades diagonally oriented counter-rotationally and fixed to the bottom inside surface of the third annulus, wherein each of said plurality of radially spaced auger blades has an attacking surface, a bottom end and a top end, and further wherein the bottom end of each of said plurality of radially spaced auger blades terminates at the top rim of the third annulus; and, b. a row of evenly spaced abrasive elements adjacent and parallel to the attacking surface of each blade of said plurality of radially spaced auger blades so that in operation, as the dry drill bit is rotating, said row of evenly spaced abrasive elements crushes the cuttings whereupon each radially spaced auger element of the plurality of radially spaced auger elements sweeps the cuttings from the third annulus into an adjacent radially extending channel for carriage by centrifugal force away from the bit head.

30. A rotating dry drilling bit for drilling an annular bore hole into a body of rock and obtaining a core sample from said body of rock, said rotating dry drill bit comprising:

a. an annular steel body having a first annulus, a first inside diameter, a bottom end and a top end, said top end adapted for coupling with a rotatable drill string, said drill string having an second annulus with a second inside diameter;

b. a bit crown comprising a hard metal matrix formed onto said bottom end of said annular steel body using a powdered metallurgy process, wherein said bit crown has a top end and a bottom end and comprises:

i. a third annulus having a third inside diameter, a bottom rim and a top rim, said third annulus extending through said bit crown, wherein the third annulus is co-axial with said first and second annuli and adapted to receive and pass said core sample to the annular steel body first annulus and hence to the drill string second annulus;

ii. a bit head having a radial profile for rotatively cutting into the body of rock thereby forming the core sample and creating cuttings;

iii. a plurality of radially extending channels formed therein and evenly spaced thereabout, said channels having a surface area, a bottom tip and a top tip and adapted for carrying said cuttings away from the bit head, wherein said plurality of radially extending channels have a constant width from said top tip to said bottom tip;

iv. a plurality of radially extending cutting blades formed therein and evenly spaced thereabout, said plurality of radially extending cutting blades having a surface area, a bottom tip and a top tip, wherein the width of each cutting blade of the plurality of cutting blades is consistent from said bottom tip to said top tip, wherein each one of said plurality of radially extending cutting blades is separated by one of said plurality of radially extending channels; and, v. a plurality of radial outer faces adjacent to and above said bit head, wherein:

1. each radial outer face of said plurality of radial outer faces is integral to an adjacent radially extending cutting blade;
2. the plurality of radial outer faces is adapted for stabilizing the bit head against angular deviation and gauging said bore hole;
3. each radial outer face of said plurality of radial outer faces comprises a plurality of vertically oriented and parallel splines embedded therein; and, c. a transition zone adapted for receiving the cuttings from the plurality of tapered radially extending channels, wherein said transitional zone is integral to and above the bit crown and comprises an vertical surface extending at a predetermined angle from the top of the radial outer face to the surface of the annular steel body, so that the transitional zone receives cuttings from the plurality of channels and transfers them to an auguring means located above the transitional zone for transport out of the bore hole.

31. The rotating dry drilling bit as claimed in claim 30, wherein each one of the plurality of radially extending cutting blades and each one of the radially extending channels is oriented diagonally at an predetermined angle away from the vertical and towards the direction of rotation.

32. The dry drilling bit as claimed in claim 31, wherein said third annulus top rim is characterized by a projection having a variable length and an inwardly oriented tip extending a predetermined distance into the third annulus thereby defining the third annulus top rim diameter from said tip to the opposite side of the rim to the diameter of the core sample, wherein said projection is in sliding contact with the core sample, applies tension to the core sample thereby causing it to separate from the body of rock and gauges the core sample.

33. The rotating dry drilling bit as claimed in claim 32, wherein each tapered radially extending cutting blade of said plurality of tapered radially extending cutting blades has a bottom tip and a top tip, and wherein said bottom tip extends horizontally across the third annulus a distance equal to said predetermine distance.

34. The rotating dry drilling bit as claimed in claim 33, wherein each tapered radially extending channel of said plurality of tapered radially extending channels has a bottom tip and a top tip, and wherein said channel bottom tip terminates at said bottom rim.

35. The rotating dry drilling bit as claimed in claim 34, wherein the diameter of the core sample is determined by the distance between the opposite top tips of the plurality of tapered radially extending cutting blades.

36. The rotating dry drilling bit as claimed in claim 35, wherein a pocket is formed above the projection and between the projection and the bottom of the adjacent tapered radially extending cutting blade, said pocket adapted for collecting cuttings within the third aperture.

37. The rotating dry drilling bit as claimed in claim 36 further including means for removing cuttings from the third aperture.

38. The rotating dry drilling bit as claimed in claim 37, wherein said means comprises:

a. a plurality of radially spaced auger blades diagonally oriented counter-rotationally and fixed to the bottom inside surface of the third annulus, wherein each of said plurality of radially spaced auger blades has an attacking surface, a bottom end and a top end, and further wherein the bottom end of each of said plurality of radially spaced auger blades terminates at the top rim of the third annulus; and, b. a row of evenly spaced abrasive elements adjacent and parallel to the attacking surface of each blade of said plurality of radially spaced auger blades;

so that in operation, as the dry drill bit is rotating, said row of evenly spaced abrasive elements crushes the cuttings whereupon each radially spaced auger element of the plurality of radially spaced auger elements sweeps the cuttings from the third annulus into an adjacent radially extending channel for carriage by centrifugal force away from the bit head.

39. A rotating dry drilling bit for drilling an annular bore hole into a body of rock and obtaining a core sample from said body of rock, said rotating dry drill bit comprising:

a. an annular steel body having a first annulus, a first inside diameter, a bottom end and a top end, said top end adapted for coupling with a rotatable drill string, said drill string having an second annulus with a second inside diameter;

b. a bit crown comprising a hard metal matrix formed onto said bottom end of said annular steel body using a powdered metallurgy process, wherein said bit crown has a top end and a bottom end and comprises:

i. a third annulus having a third inside diameter, a bottom rim and a top rim, said third annulus extending through said bit crown, wherein the third annulus is co-axial with said first and second annuli and adapted to receive and pass said core sample to the annular steel body first annulus and hence to the drill string second annulus;

ii. a bit head for rotatively cutting into the body of rock thereby forming the core sample and creating cuttings, said bit head comprising a plurality of cutting elements having a cylindrical shape, a diameter, a thickness, a flat circular attacking face having a circumference and a lagging face, wherein said attacking face has a cutting edge which will engage the body of rock about said circumference;

iii. an opening between each of said plurality of cutting elements, wherein said opening is adapted to remove cuttings away from the bit head;

iv. a plurality of radial outer faces integral to the bit crown and disposed above the plurality of cutting elements, wherein said outer faces are adapted for stabilizing the bit head against angular deviation and gauging said bore hole; and, c. a transition zone adapted for receiving said cuttings from the openings for transport away from the bit crown.

40. The rotating dry drilling bit as claimed in claim 39, wherein the cutting elements are oriented at a predetermined rake angle so that each of said attacking faces is angled to attack the body of rock.

* * * * *